US006851603B1

(12) United States Patent
Carlson et al.

(10) Patent No.: US 6,851,603 B1
(45) Date of Patent: Feb. 8, 2005

(54) PIZZA BOX

(75) Inventors: Robert C. Carlson, Louisville, KY (US); Owen Glock, Valparaiso, IN (US); Dana M. Tilley, Shelbyville, KY (US); Stanley E. Knierim, Indianapolis, IN (US); Melissa M. Bailey, Louisville, KY (US)

(73) Assignee: Papa John's International, Inc., Louisville, KY (US)

( * ) Notice: Subject to any disclaimer, the term of this patent is extended or adjusted under 35 U.S.C. 154(b) by 0 days.

(21) Appl. No.: 10/745,235

(22) Filed: Dec. 22, 2003

(51) Int. Cl.[7] ..... B65D 5/42

(52) U.S. Cl. ..... 229/148; 206/562; 229/904; 229/906

(58) Field of Search ..... 229/148, 902, 229/904, 906; 206/562, 563, 564, 565

(56) References Cited

U.S. PATENT DOCUMENTS 2,547,716 A * 4/1951 Murphy ..... 206/562
2,803,390 A * 8/1957 Mackay ..... 229/904
2,924,372 A * 2/1960 Kirkeby ..... 206/563
3,094,264 A * 6/1963 Petrone ..... 206/562
3,565,323 A * 2/1971 Katzenmayer ..... 229/904
4,497,433 A * 2/1985 Wischusen, III ..... 206/563
4,572,423 A * 2/1986 Spencer ..... 229/904
4,863,094 A * 9/1989 Morrow et al. ..... 229/904
5,788,081 A * 8/1998 Bates ..... 206/562
5,890,648 A * 4/1999 Cai ..... 229/148
6,213,389 B1 * 4/2001 Cai ..... 229/904
6,568,586 B1 * 5/2003 VanEsley et al. ..... 229/904

* cited by examiner

*Primary Examiner*—Gary E. Elkins
(74) *Attorney, Agent, or Firm*—John F. Salazar; Middleton & Reutlinger

(57) ABSTRACT

A pizza box is provided which has a top wall, bottom wall, rear and front wall and opposing side walls while also having an angled support surface which extends from the top wall to the front wall. Within the angled support surface are provided cup apertures for receiving containers which are maintained securely fitted within the apertures while also viewable from the exterior of the pizza box.

13 Claims, 7 Drawing Sheets

PIZZA BOX

BACKGROUND OF THE INVENTION

This present invention is directed towards a pizza box having a front angle support surface within which cups or other material may be placed.

BRIEF DESCRIPTION OF THE DRAWINGS

This invention may be more clearly understood with the following detailed description and by reference to the respective drawings in which.

DETAILED DESCRIPTION OF THE PREFERRED EMBODIMENTS

Figure 1:
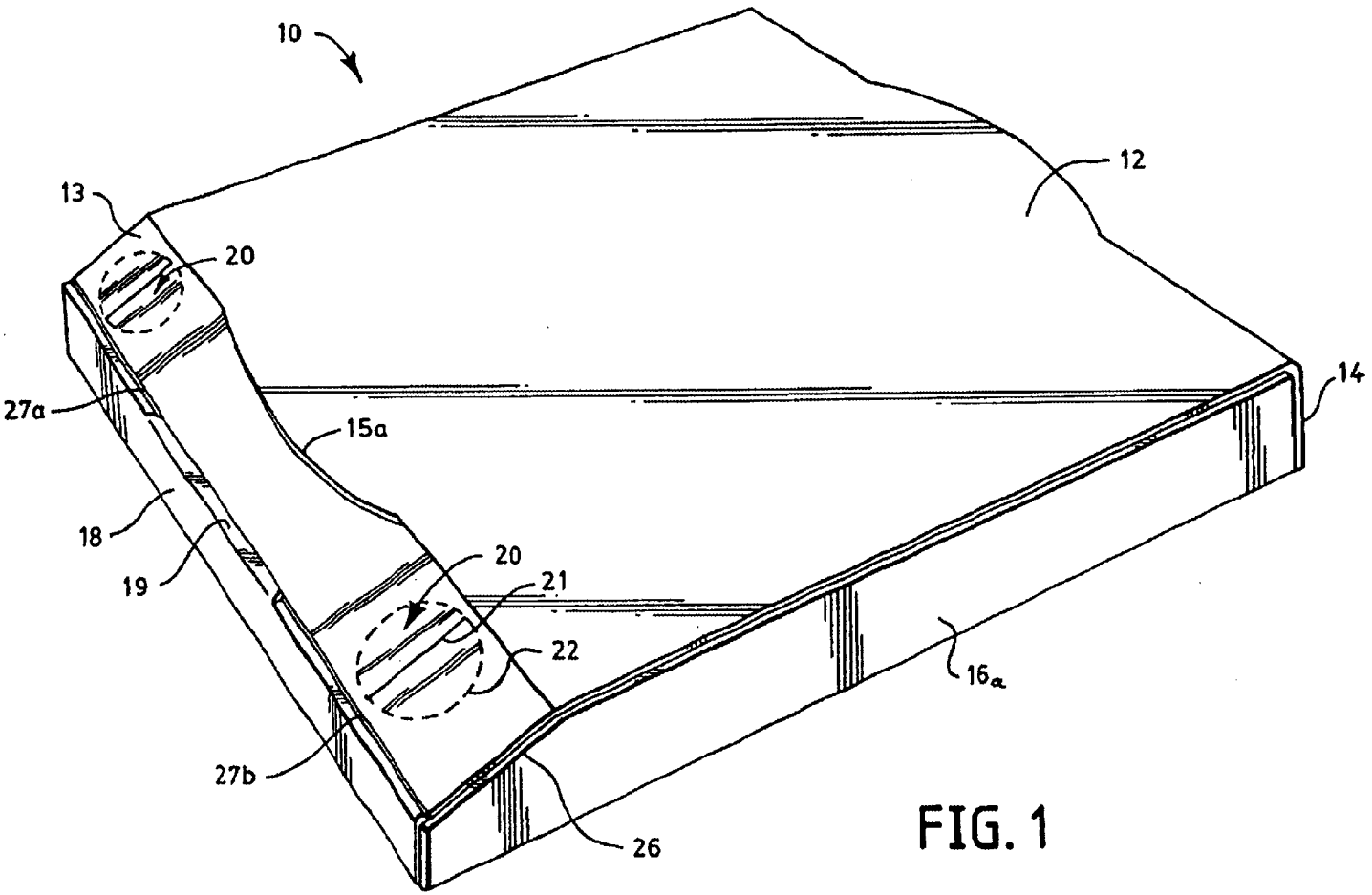
FIG. 1 is a top perspective view of the pizza box of the present invention.

Referring now to FIG. 1, the pizza box 10 of the present invention is depicted in the figures. Generally, the pizza box 10 of the present invention may be made of corrugated cardboard or other paper based material or may be similarly made of any containment material within which an edible food type item may be stored. As depicted in the figures, the pizza box 10 of the present invention is shown having a top wall 12 and opposing bottom wall 11, with both the top wall 12 and bottom 11 forming a space therebetween by having a first side wall 16*a* and second side wall 16*b* as well as rear wall 14 and front wall 18 placed therebetween. Top wall 12 may be hinged to rear wall 14. Additionally, extending outward and angularly downward from the front wall to possibly contact, frictionally engage or merely be adjacent to the front wall 18 is angled support surface 13 which angles downward from a front edge of a flat planar section of the top wall 12. The interior space formed by the walls of the pizza box 10 provides sufficient area to place edible material such as a pizza or other food item.

Figure 2:
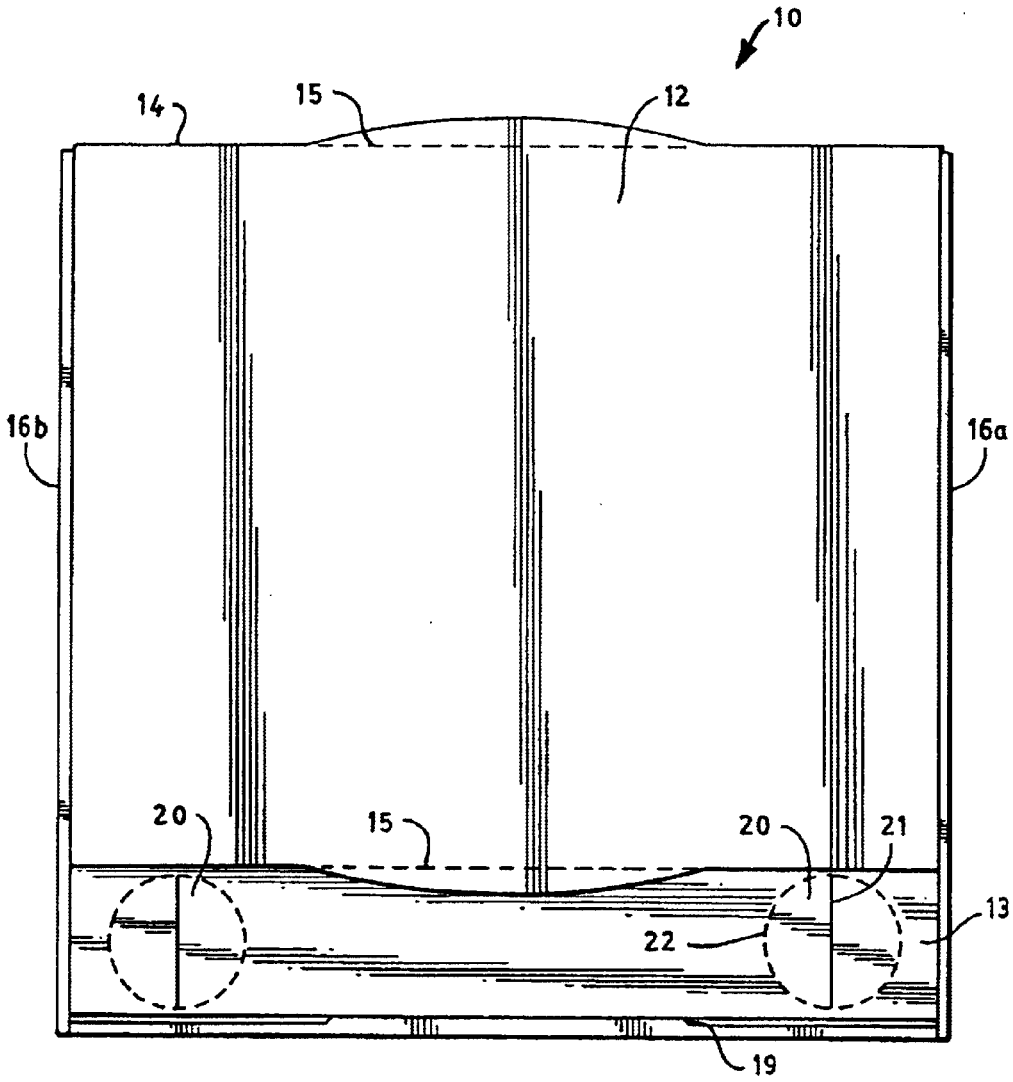
FIG. 2 is a top view of the pizza box of the present invention.
Figure 3:
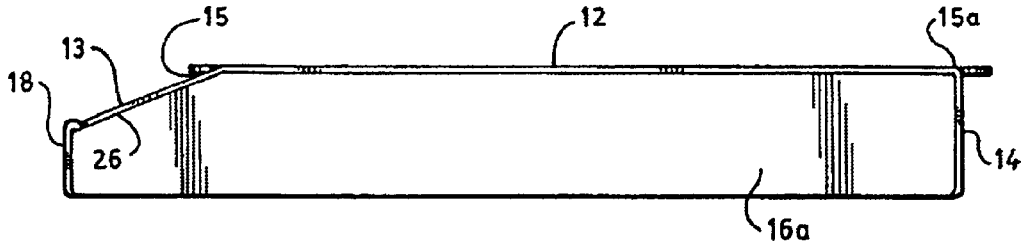
FIG. 3 is a right side view of the pizza box of the present invention.
Figure 4:
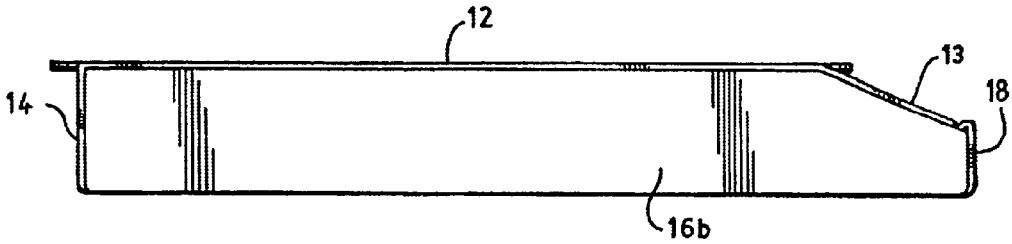
FIG. 4 is a left side view of the pizza box of the present invention.
Figure 5:
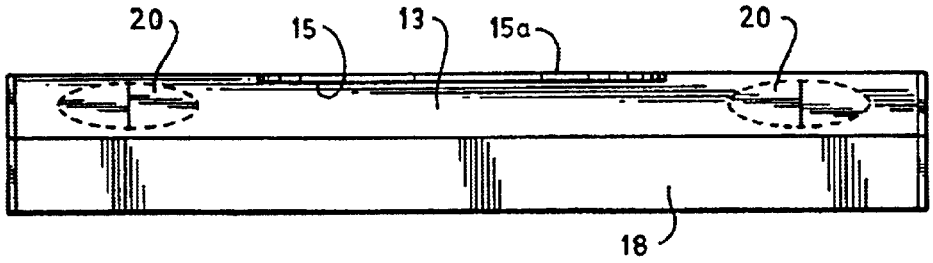
FIG. 5 is a front view of the pizza box of the present invention.
Figure 6:
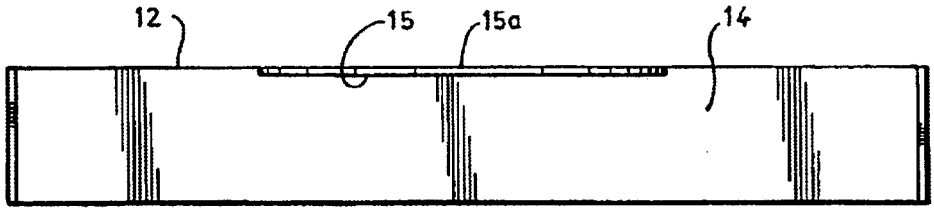
FIG. 6 is a rear view of the pizza box of the present invention.
Figure 7:
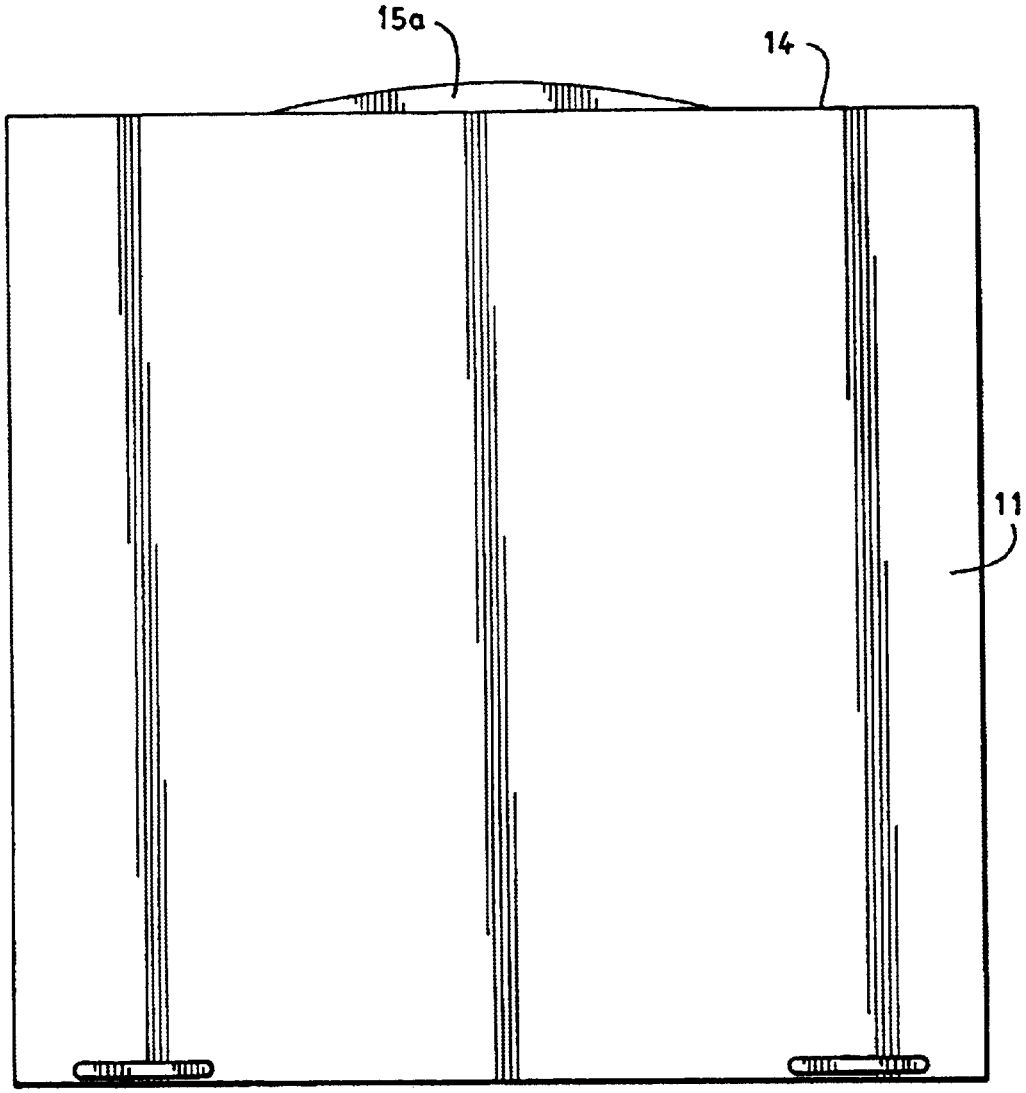
FIG. 7 is a bottom view of the pizza box of the present invention.

As shown in the figures, the top wall is substantially square and may have ovalized extensions on the front and rear edge in the form of lip extension 15*a*. Below the lip extension 15*a* is a radius or venting aperture 15, as shown in FIG. 2, which allows venting from the interior of the pizza box 10.

It is typical in pizza boxes to provide containers with the pizza for condiments such as extra sauce, butter, or other materials. These containers come in many different designs and have traditionally been inserted into the interior of the pizza box. Sometimes these containers can contact the edible material inside the pizza box and potentially cause damage thereto or they may slide around in the interior of the pizza box. At times these containers may be shaped other than circular or cylindrical and be trapezoidal and placed in the corners of the pizza box on the interior thereof. It may be desirable to secure the containers within the pizza box so that at least a portion of the container is contained within the box in order to maintain it at a higher temperature.

Figure 8:
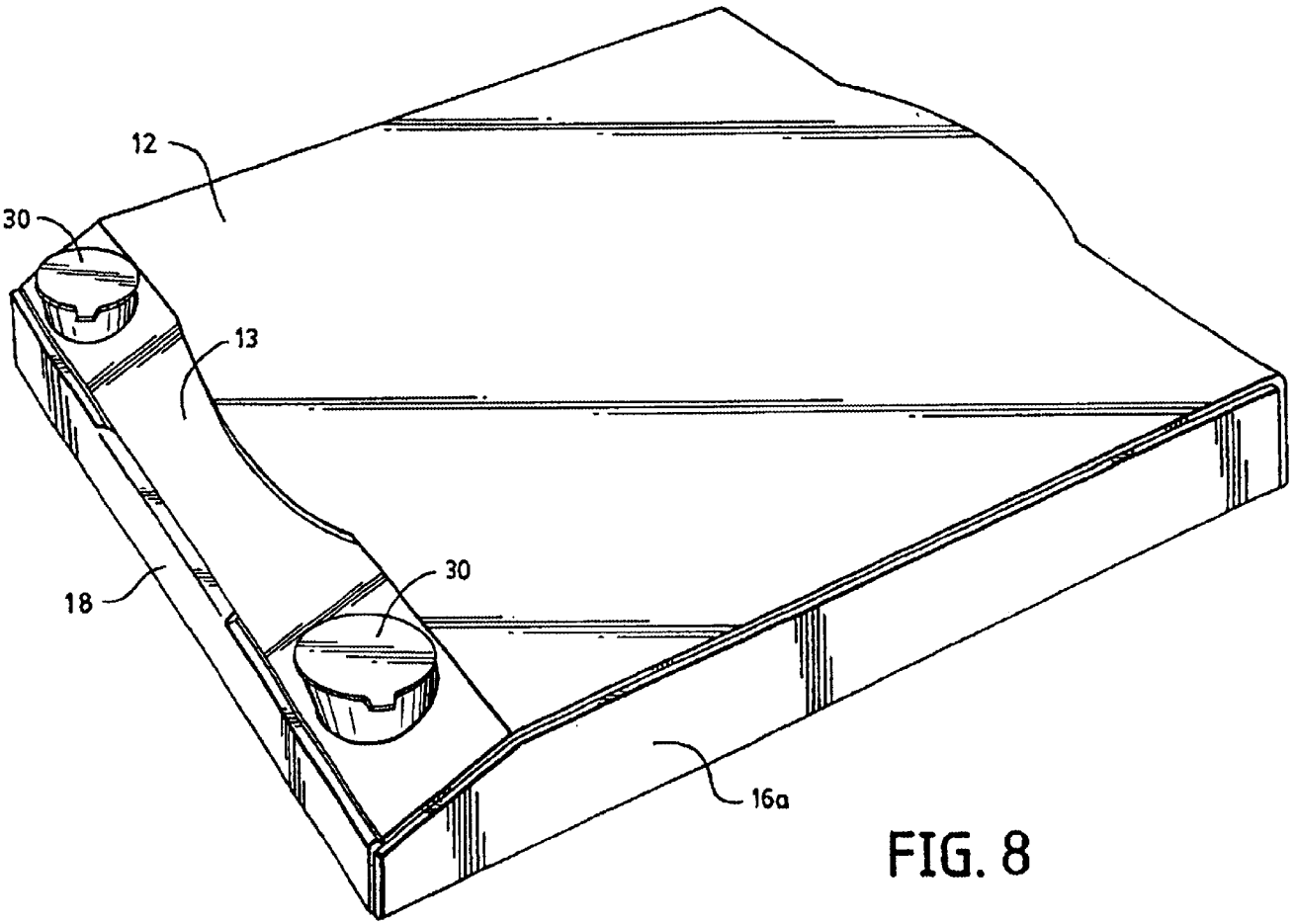
FIG. 8 is a top perspective view of the pizza box of the present invention with containers placed and retained therein; and, FIG. 9 is a plan view of the corrugated blank which forms the pizza box of the present invention.

As shown in the figures, the pizza box 10 of the present invention has a downwardly extending front angle support system with at least one cup aperture 20 formed therein. As shown in the figures, the at least one cup aperture 20 is formed by a score line 22 and is made readily puncturable by the diametrically formed score line or slit 21. It would be desirable such that the cup aperture 20 matches the particular shape and size of the container shown in FIG. 8 so that the container may be readily placed in the interior of the cup aperture and retained therein. Additionally, as shown in FIG. 8 and as is depicted in the drawings, once the container 30 is inserted through the cup aperture 20, a majority of the container is exposed to the interior of the box thereby being exposed to the warm temperatures therein caused by the pizza or other hot food item stored.

The cup aperture 20 is formed as indicated by a circular score line 22. Of course, any size or dimension or geometry cup aperture may be utilized for storing of the container so that it is partly exposed to the exterior of the pizza box 10 while also being secured and internally positioned. Additionally, as is depicted in the figures for the present example, a circular score line may be formed. The score line 22 depicted in the figures has a diametrically formed slit or score line 21 which is easily penetrative. Within each of the circular score lines 22 are formed, approximately at the 9 O'clock and 3 O'clock positions retainer sections. These retaining sections are formed by the score line being discontinued for approximately ⅜ inch such that the cardboard section on the interior of the score line definition 22 does not fall into the interior of the pizza box once penetrated. Thus, upon insertion of the container 30 into the cup aperture 20, the cup aperture forms semi-circular halves which are separated at the diametrically formed slit 21. However, each of the semi-circular halves are retained on the angle support surface 13 by the lack of or reduced score line formation at opposing sides of the score line aperture.

As shown in the figures, the container 30 may be inserted into the cup aperture 20 at the angled support surface 13 so that the lid of the container 30 is readily viewable and can be angled outward due to the downward angle of the surface 13. This may be desirable from the standpoint of the manufacturer since it provides additional advertisement or logo space for easily recognizable containers or color schemes. Further, as is readily seen, the portions of the containers may easily fit into the interior of the pizza box and be maintained in a warm condition. The containers 30 may have an outwardly extending upper lip which has a diameter larger than the diameter of the cup aperture 20. The diameter of the cup or container 30 may be slightly less than the diameter of the cup aperture 20. As a result, the container may readily slid into the cup aperture 20 thereby separating the score lines appropriately and be held into place by the lip of the container resting against the angled support surface 13.

As shown, the cup aperture 20 may roughly match the diameter of the containers 30 as depicted. In one embodiment, the cup aperture 20 may have a diameter of approximately 2 3/16 inch. However, many different diameters and geometries may be utilized to match or similarly be designed to the container utilized.

Figure 9:
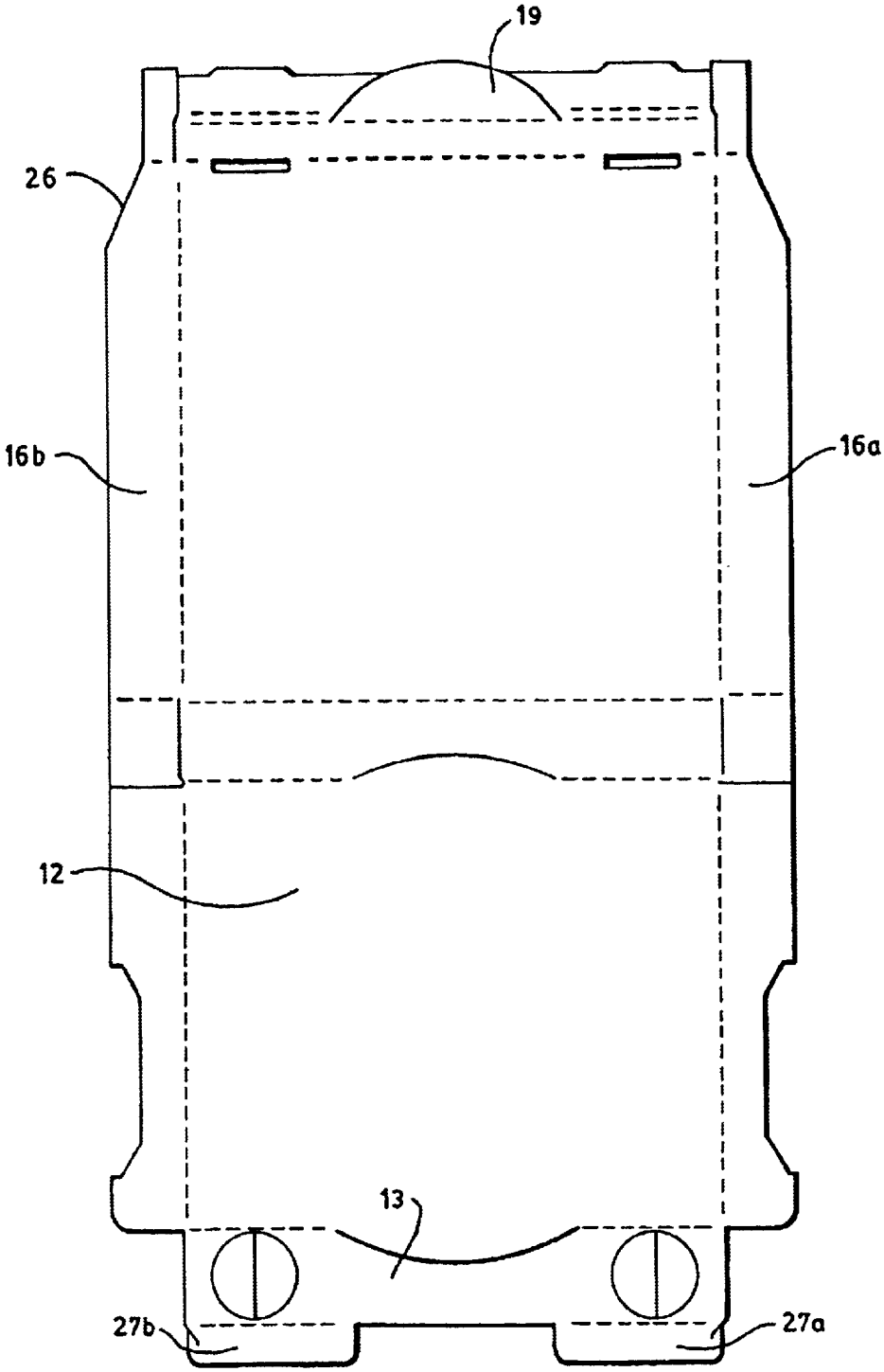

As shown in the figures, the top wall may have the downwardly angled support surface 13 extending from a front edge thereof. A matching side wall bevel 26 may be placed on either side of the side wall 16*a* and 16*b*. The side wall bevels 26 closely match the downward angle support surface 13. In addition to the angle support surface 13 having the cup apertures 20 formed therein, by providing the angle support surface 13 some vertical support is given to the top wall 12. As it known in the art, providing very large pizza boxes which have significant surface area on the top wall may cause the top wall to sag downward due to its own weight and lack of vertical support. As depicted in the pizza box 10 of the present invention, the angled support surface 13, by virtue of it being downwardly angled and contacting the bottom wall 11 through the use of the top wall flaps 27*a* and 27*b*, shown in FIG. 9, vertical support is given even after extending the total surface area of the top wall forward to the front wall 18. Thus, as depicted in one of the embodiments, the benefits of providing the angled support surface 13 arise in additionally providing vertical support to the top wall 12. However, the top wall 12 may easily extend completely forward to the front wall and similarly contain the cup apertures 20 without having an angled surface as depicted.

Also shown in FIG. 1 and in the rest of the remaining figures, is the front wall flap 19 which extends inwardly from the front wall 18 and is positioned in between the top wall flaps 27*a* and 27*b*. The front wall flap 19 may frictionally engage the top wall flaps 27*a* and 27*b* or may be positioned therebetween and contain messaging or other advertising information.

Overall, the pizza box 10 of the present invention may be constructed of standard materials and fold lines as are necessary and known in the manufacturing of similar type food containers. Further, while specific reference has been provided herein to containers and specific geometry of the container and pizza box, no unlimiting interpretation of the examples are to be interpretable as the embodiments and examples provided herein are exemplary only. Thus, various modifications which are apparent to one skilled in the art are within the scope of this invention and described in the included claims.

We claim:

1. A pizza box with a front angled support surface, comprising:

a top wall, a bottom wall, first and second opposing sidewalls, each extending upward from said bottom wall, a rear wall hingedly connected to said top wall, an angled support surface angularly extending downwardly from a front edge of said top wall to internally engage a front wall, said front wall upwardly extending from said bottom wall and opposing said rear wall, said angled support surface having at least one cup aperture formed therethrough.

2. The pizza box of claim 1 wherein at least one cup aperture is circularly defined on said angled support surface by a score line.

3. The pizza box of claim 2 wherein said at least one cup aperture further has a score line diameter centrally formed.

4. The pizza box of claim 1 wherein said top wall further has at least one downwardly extending top wall flap to engage said bottom wall.

5. The pizza box of claim 4 wherein said front wall further has an inwardly directed front wall flap.

6. The pizza box of claim 3 wherein said at least one cup aperture on said pizza box is a first and a second cup aperture formed on opposing sides of said angled support surface.

7. A pizza box having storage apertures for storing of container cups, comprising:

a top wall opposing a bottom wall and having a rear wall, first and second side walls and a front wall interposed therebetween;

said top wall having a beveled cup aperture containing surface adjacent said front wall, said first and said second side walls having a side wall beveled matching said bevel cup aperture containing surface;

said beveled cup aperture containing surface having at least one cup aperture score line formed therethrough.

8. The pizza box of claim 7 wherein said front wall has a predefined height less than said rear wall.

9. The pizza box of claim 8 wherein said beveled cup aperture containing surface has a first and a second cup aperture score line on opposing sides.

10. The pizza box of claim 9 wherein each of said cup aperture score lines further have diametrically extending score lines.

11. The pizza box of claim 7 wherein said top wall further has a semi-circular outward lip extension forming a radius aperture below said lip extension.

12. A pizza box having external storage apertures for retaining container cups, comprising:

a top wall hingedly connected to a rear wall and opposing a bottom wall, opposing first end second side walls, a front wall extending upward from said bottom wall and opposing said rear wall, said top wall having at least one downwardly extending top wall flap to contact said bottom wall, said top wall further having a downwardly angled support surface interposed between a flat planar surface and said at least one top wall flap, said angled support surface having at least one cup aperture formed therein, said at least one cup aperture defined by a circular score line in combination with a diametrically extending score line.

13. In combination with a container cup, a pizza box having an aperture for external storage of said container cup comprising: a top wall and opposing bottom wall, said top wall connected to a rear wall, a first and a second opposing side wall extending upwardly from said bottom wall, a front wall extending upwardly from said bottom wall, said front wall having a predefined height, said predefined height of said front wall being less than a predefined height of said rear wall, said top wall having a downwardly angled extension, said downwardly angled extension having a first and a second cup aperture formed therein, each of said cup apertures defined by a score line and matching the geometric shape of a first and a second container secured therein, each of said first and said second containers having a top surface and a downwardly extending container portion, each of said containers sized to fit within said container apertures.

* * * * *